US005635971A

United States Patent [19]

Aono et al.

[11] Patent Number: 5,635,971

[45] Date of Patent: Jun. 3, 1997

[54] RECORDING MEDIUM INCLUDING LATENT IMAGE CHARGE TRAP AND METHODS INVOLVING SAME

[75] Inventors: Takashi Aono; Yoshiaki Tsuruoka; Masayuki Iijima; Kayoko Sugiyama, all of Tokyo, Japan

[73] Assignee: Dai Nippon Printing Co., Ltd., Tokyo, Japan

[21] Appl. No.: 244,499

[22] PCT Filed: Sep. 28, 1993

[86] PCT No.: PCT/JP93/01380

§ 371 Date: May 27, 1994

§ 102(e) Date: May 27, 1994

[30] Foreign Application Priority Data

Sep. 30, 1992 [JP] Japan ..... 4-261141

[51] Int. Cl.[6] ..... B41J 2/41

[52] U.S. Cl. ..... 347/112; 347/164; 347/139

[58] Field of Search ..... 347/112, 164, 347/139

[56] References Cited

U.S. PATENT DOCUMENTS 4,988,597 1/1991 Spiewak et al. ..... 430/62

5,187,496 2/1993 Yu ..... 428/220

FOREIGN PATENT DOCUMENTS 55-81348 6/1980 Japan .

1-296256 11/1989 Japan .

4-189802 7/1992 Japan .

*Primary Examiner*—Mark J. Reinhart

*Attorney, Agent, or Firm*—Sughrue, Mion, Zinn, Macpeak & Seas

[57] ABSTRACT

The electrostatic information recording medium of the invention has on at least an electrode an information recording layer comprising a product obtained by contact of a polymer having a fluorine-containing aliphatic ring structure with fluorine gas, on which layer a latent image charge trap is retained. This electrostatic information recording medium enables electrostatic information such as an electrostatic latent image to be recorded in the form of a charge trap rather than an electrostatic charge, and so may be used as an electrostatic printing master by way of example.

7 Claims, 3 Drawing Sheets

RECORDING MEDIUM INCLUDING LATENT IMAGE CHARGE TRAP AND METHODS INVOLVING SAME

TECHNICAL FIELD

The present invention relates to an electrostatic information recording medium having an information recording layer stacked or otherwise formed thereon, in which layer a latent image charge trap is retained on an electrode as well as a method of forming such a latent image charge trap and a method of recording and reproducing electrostatic information. The electrostatic information recording medium of the invention enables electrostatic charges to be caught in the trap and so is useful as an electrostatic printing master.

BACKGROUND TECHNIQUE

So far, various proposals have been made of the technique according to which, while a photosensitive material having an electrode layer and a photoconductive layer stacked on a base or substrate in this order is opposed to an electrostatic information recording medium having an electrode layer and a charge carrier layer stacked on a base or substrate in this order, voltage is applied between both the electrodes to expose the recording medium to image-bearing light, thereby recording an electrostatic latent image in the charge carrier layer. This technique makes analog recording of very high resolution, and so provides an excellent electrostatic information recording method. However, a problem with this method is that the surface charges recorded on the surface of the charge carrier layer is likely to attenuate gradually due to atmospheric moisture, dust, and so on. Another problem is that the electrostatic latent image is destroyed upon something externally applied thereto or coming into contact therewith.

To solve such problems, it has been proposed to stack a protecting layer on the surface of the charge carrier layer after an electrostatic latent image is formed thereon. It has also been put forward to form a charge carrier layer by stacking a photoconductive or electrically conductive layer on an electrically insulating layer in a pixel unit pattern and stacking a thin film form of electrically insulating resin layer on the conductive layer, and allow an electrostatic latent image formed on the surface of the charge carrier layer to pass through the thin film form of electrically insulating resin layer due to a tunneling phenomenon for accumulation on the photoconductive or electrically conductive layer, thereby retaining the electrostatic latent image in the recording medium.

However, when the charge carrier layer is merely made up of a resin of high insulating properties, not only is there a problem that the carried charges attenuate with time, but it is also required to keep the electrostatic latent image in store. Problems with patterning the information recording layer are that the process of fabricating the electrostatic information recording medium is complicate, and some limitation is placed on resolution as well, although depending on pixel size.

The present invention has been accomplished so as to provide a solution to the problems mentioned above; it is an object of the invention to provide an electrostatic information recording medium and a method of recording and reproducing electrostatic information, which enable electrostatic information such as an electrostatic latent image to be recorded in the form of a charge trap, rather than an electrostatic charge.

DISCLOSURE OF THE INVENTION

According to one aspect of the invention, there is provided an electrostatic information recording medium having on at least an electrode an information recording layer comprising a product obtained by contact of a polymer having a fluorine-containing aliphatic ring structure with fluorine gas, characterized in that a latent image charge trap is formed and retained on said information recording layer.

According to another aspect of the invention, there is provided a method of forming a latent image charge trap, characterized in that an electrostatic information recording medium having on at least an electrode an information recording layer comprising a product obtained by contact of a polymer having a fluorine-containing aliphatic ring structure with fluorine gas is irradiated with either at least one member selected from the group consisting of electrons, atoms, molecules and ions or light, or the information recording layer is mechanically treated on the surface or stacked thereon with an electrically conductive or insulating substance, thereby forming a latent image charge trap on the information recording layer.

According to still another aspect of the invention, there is provided a method of recording and reproducing electrostatic information, characterized by:

providing an electrostatic information recording medium having on at least an electrode an information recording layer comprising a product obtained by contact of a polymer having a fluorine-containing aliphatic ring structure with fluorine gas, uniformly charging the surface of the information recording layer of the electrostatic information recording medium on which layer a latent image charge trap is retained, catching electrostatic charges in said trap, and reading said electrostatic charges, or developing them with a toner to reproduce an image recorded on the information recording layer.

The information recording layer of the electrostatic information recording medium according to the invention is made up of a product obtained by contact of a polymer having a fluorine-containing aliphatic ring structure with fluorine gas, and has the property of being incapable of accumulating charges and so allowing them to leak under weak charging conditions. However, when the information recording layer is charged under strong charging conditions, exposed to light with the application of voltage while a photosensitive material is used in combination, irradiated with ions, electrons or light, or mechanically treated on the surface, a latent image charge trap is formed thereon.

When latent image charges are caught in the trap, heating causes only leakage of the charges from the trap; the trap itself does not disappear. When the trap is re-charged under weak conditions using a corona charger, the trap re-catches charges, so that an electrostatic latent image can be easily formed.

According to the electrostatic information recording medium of the invention, the trap having the ability to be charged remains even after the recorded electrostatic latent image is erased; it is possible to re-accumulate charges and so improve the security of recorded information much more than ever before.

Also the electrostatic information recording medium of the invention enables imagewise information to be patterned for recording in the form of charged and uncharged regions, and so may be used as an electrostatic printing master which is to undergo repeated uniform charging, toner development and toner transfer to paper.

BEST MODE FOR CARRYING OUT THE INVENTION

Figure 1:
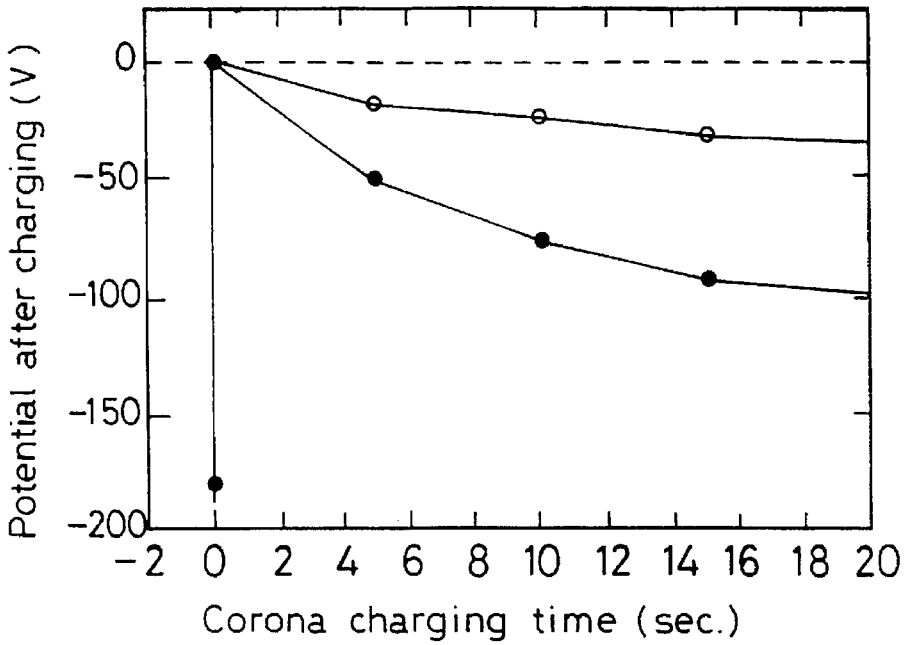
FIG. 1 is a graphical view showing the relation between the corona charging time (sec.) and the potential-after-charging (V) when the regions—on which voltage was, and was not, applied—of the electrostatic information recording medium of the invention fabricated with the use of a photosensitive material were charged by means of a corona wire.

The information recording layer according to the invention will now be explained.

The information recording layer is made up of a fluorocarbon resin layer obtained by contact with fluorine gas with a polymer having a volume resistivity of at least $10^{14}$ (Ω·cm) and a fluorine-containing aliphatic ring structure. The polymer having a fluorine-containing aliphatic ring structure, for instance may be one having on the main chain such specific ring structures as mentioned below.

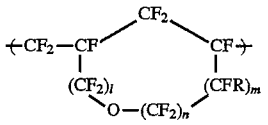

where l is 0 to 5, m is 0 to 4, and n is 0 to 1 with the proviso that l+m+n=1 to 6, and R is F or $CF_3$.

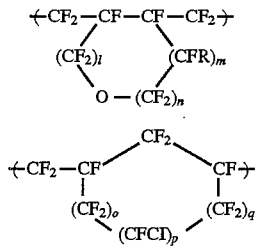

where o, p, and q are 0 to 5 with the proviso that o+p+q=1 to 6.

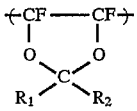

where $R_1$ and $R_2$ each stand for F or $CF_3$.

Representative of these are polymers having the following ring structures.

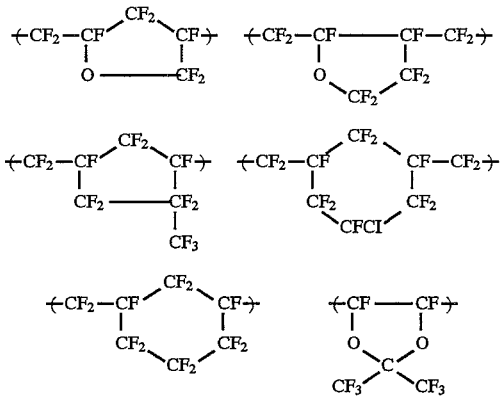

Polymers having perfluoro aliphatic ring structures are mentioned by way of example. These polymers may have some fluorine atoms substituted by other atoms such as hydrogen atoms or organic groups. In addition, mention may be made of polymers having the following ring structures, which may be obtained by metathesis polymerization.

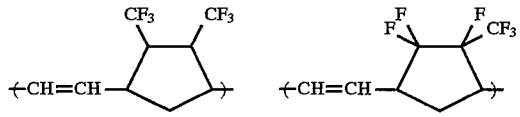

The polymers having a fluorine-containing aliphatic ring structure may be prepared by using as the starting material fluorine-containing monomers referred to in JP-A 4-189802 according to the production method set forth in the same specification as mentioned above. Here it is noted that Polymer A prepared in one example of that specification, for instance, is available under the trade name of "Cytop" of standard grade made by Ashahi Glass Co., Ltd. The polymers having a fluorine-containing aliphatic ring group may have been crosslinked.

The information recording layer according to the invention is obtained by contact of the polymer having a fluorine-containing aliphatic ring structure with fluorine gas. By way of illustration but not by way of limitation, one example of preparing this information recording layer will now be given.

EXAMPLE OF PREPARATION OF INFORMATION RECORDING LAYER

Placed in a pressure-resistant glass autoclave having an internal volume of 200 ml were 35 g of perfluorobutenyl vinyl ether, 5 g of R113, 150 g of ion-exchanged water, 25 g of methanol, and 90 mg of a polymerization initiator, i.e., diisopropyl peroxydicarbonate. After the system had been replaced inside three times by nitrogen, a 23-hour suspension polymerization was carried out at 40° C. to obtain 28 g of a polymer A.

By measuring the infrared absorption spectra of this polymer A, it was found that there is no absorption in the vicinity of 1550 $cm^{-1}$ and 1840 $cm^{-1}$, which might otherwise be attributed to the double bond present in the monomer. By measuring the $^{19}F$ NMR spectra, a spectrum showing the following recurring unit was obtained.

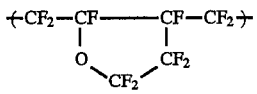

The polymer A has a glass transition point of 110° C., and is a glass material that is transparent at room temperature. Also, this polymer has a 10% heat decomposition temperature of 462° C., a water absorption of up to 0.01%, a dielectric constant of 2.2 (80 Hz to 1 MHz) at room temperature, and a volume resistivity of at least $10^{17}$ Ω·cm.

Then, 5 g of the polymer A was put into a 1-liter stainless autoclave. After the system atmosphere had been replaced three times with nitrogen, the system was reduced to 30 Torr. Following this, fluorine gas diluted to 14% with nitrogen was introduced into the system to a pressure of 760 Torr for a six-hour contact treatment at 230° C., which yielded 5 g of a polymer B. A fluorinated product like the polymer B is disclosed in JP-A 4-189802 and, for instance, is available under the trade name of Cytop with a high permeability to ultraviolet rays, Asahi Glass Co., Ltd.

The information recording layer according to the invention is formed by dissolving this fluorocarbon resin treated with fluorine gas in a fluorine base solvent such as perfluoro (2-butyltetrahydrofuran) to prepare a 2% to 13% solution, and coating the resulting solution on an electrode by means of such coating techniques as spinner coating, dipping, or blade coating. The recording information layer may have a thickness of 1 μm to 10 μm, preferably 1 μm to 5 μm, as measured after drying.

The thus obtained information recording layer has the property of being substantially incapable of building up charges, even when it is charged on the surface with weak coronas at room temperature (25° C.), because charges transfer in the widthwise direction of the layer. The polymers treated by the procedure disclosed in Comparative Examples 1 and 2 of JP-A 4-189802 have no such carrier transport properties. The reason this specific polymer having a fluorine-containing aliphatic ring structure loses its ability to be charged by the contact treatment with fluorine gas is presumed to be that its end group is deactivated by the treatment with fluorine gas.

When this specific information recording layer is charged with strong coronas, however, it comes to have the ability to be charged. Even upon the built-up charges erased from this information recording layer as by heating, an imagewise form of charge trap continues to remain thereon. It has now been found that charges can again be accumulated on this trap.

According to the invention, the latent image charge trap can be formed by the following methods (1) to (4).

(1) The latent image charge trap can be formed by charging the surface of the information recording layer at a corona voltage higher than a certain voltage (or under strong conditions). At a voltage lower than that certain voltage no latent image charge trap occurs. After charged under such strong conditions, the charges are stably held in the trap, but they are erased therefrom by either heating or the application of opposite charges. In the information recording layer according to the invention, however, the trap with no charges continues to remain, even after the erasure of the charges. By charging the surface of the information recording layer at a corona voltage lower than the above certain voltage it is possible to re-accumulate charges on this trap. In other words, the information recording layer according to the invention enables latent image charges to occur by re-charging, even after the erasure of the latent image charges.

Such a latent image charge trap may otherwise be formed by the irradiation of the information recording layer with accelerated electrons such as electron beams, ion flows, atoms, molecules, etc.

Also, the latent image charge trap may be formed by opposing the electrostatic information recording medium of the invention to an information writing electrode with a gap of the order of μm between them, and applying voltage between both the electrodes for discharge recording.

In addition, an imagewise form of latent image charge trap may be formed by opposing a photosensitive material having a photoconductive layer stacked on an electrode to the information recording medium of the invention with an air gap of the order of μm between them and applying voltage between both the electrodes simultaneously with exposure to image-bearing light.

(2) The latent image charge trap may be formed by irradiating the surface of the information recording layer with light. Preferable as the light is light of wavelength shorter than that of ultraviolet light. In this case, it is noted that the thus formed trap is not charged up, but it can be charged by the corona charging as mentioned in the above (1) or other procedures.

(3) The latent image charge trap may be formed by mechanically rubbing the surface of the information recording layer.

(4) The latent image charge trap may be formed by stacking metal or other electrically conductive fine particles or fine particles of organic or other materials on the information recording layer.

For the electrode in the electrostatic information recording medium according to the invention any desired material may be used with the proviso that it has a specific resistance value of up to $10^6$ Ω·cm. For instance, an electrically conductive film of an inorganic metal or its oxide, or an electrically conductive film of an organic material such as a quaternary ammonium salt may be formed on a support either by suitable techniques such as evaporation, sputtering, CVD, coating, plating, dipping and electrolytic polymerization or by bonding. Electrode thickness must be varied depending on the electrical properties of the material forming the electrode and the voltage applied for recording information, and may be about 100 to 3,000 Å if the electrode is made up of aluminum. Then, the electrode may be formed all over the surface between the support and the information recording layer or according to the pattern of the information recording layer formed. When the information recording layer is in a film form having its own strength, an electrode material may be formed on the back side thereof by evaporation or other procedures.

The electrostatic information recording medium of the invention, when it includes a support, has a structure in which the support, electrode and resin layer are stacked one upon another in this order. No particular limitation is imposed on the material and thickness of the support, if the support has a strength enough to support the electrostatic information recording medium. For instance, use may be made of plastic films, metal foils, paper, or rigid materials such as glass, plastic sheets or metal sheets (that also serve as electrodes). When the electrostatic information recording medium is in a flexible film, tape or disk form, use may be made of a flexible plastic film, and when it is required to have some strength, use may be made of a rigid sheet or an inorganic material such as glass. It is understood that when the information recording layer is in a film form having its own strength, it is unnecessary to use the support.

The electrostatic information recording medium may take various forms depending on the type of information recorded and how to record information. For instance, when used on an electrostatic camera (an applicant's copending application JP-A 63-121591), it may have a general film (for a single or continuous frame) or disk form. When used for recording digital or analog information as by laser, it may take a tape, disk or card form.

Now how to record and reproduce electrostatic information according to the invention will be explained.

In some cases, the latent image charge trap of the electrostatic information recording medium according to the invention are already charged in the as-formed state. In this case, the recorded information-bearing charges may be either read by a potential reader or visualized as by development with toner for reproduction.

The latent image charges retained in the latent image charge trap may be erased either by heating or the application of opposite charges. However, the charge trap, even when deprived of charges, is kept as such in a stable manner. When a latent image charge trap from which charges have been removed or a latent image charge trap free from latent image charges is formed, the information recording layer is charged on the surface as by weak corona charging to accumulate charges on the charge trap. Then, the charges may be reproduced in the form of information.

The invention will now be explained specifically but not exclusively with reference to the following examples.

EXAMPLE 1

A 7% solution of CTX-807S, Asahi Glass Co., Ltd.—that is a polymer having a fluorine-containing aliphatic ring structure and treated with fluorine gas—dissolved in perfluoro(2-butyltetrahydrofuran) was spin-coated (at 700 rpm for 20 seconds) on an indium tin oxide film (of 1,000 Å in thickness and 100 Ω/□ in resistance) formed on a glass substrate by evaporation, and then leveled at 25° C. for 2 hours. Then, the product was dried at 180° C. for 1 hour to form an information recording layer of 2 μm in thickness.

Using a polyethylene terephthalate film of 6 μm in thickness as a spacer, the information recording layer of the electrostatic information recording medium was opposed to an information recording electrode plate obtained by forming an indium tin oxide film (with a thickness of 1,000 Å and a resistance value of 100 Ω/□) on a glass substrate by evaporation with an air gap between them. With the information recording electrode kept negative, a voltage of −600 V was applied between both the electrodes for 100 ms in a pattern form.

Following the application of the voltage, the surface potential of the information recording layer of the electrostatic information recording medium was measured. Consequently, the region of the recording layer on which the voltage was applied was found to have a surface potential of −62 V.

Subsequently, the electrostatic information recording medium was placed on a hot plate for a 10-second heating at 20° C., whereby the region of the recording layer on which the voltage was applied was increased to 0 V.

Using a corona charger, the regions of the information recording layer, on which the voltage was, and was not, applied were uniformly charged at a corona voltage of −7 Kv and a distance of 3 cm between the information recording layer and the corona wire for 5 seconds.

After charging, the surface potential of the information recording layer was measured. Consequently, the region of the layer on which the voltage was not applied through the above information recording electrode was found to have a surface potential −35 V, where the region with the voltage applied on it was found to have a surface potential of −145 V. This teaches that there is an improvement in the charge ability of the region of the information recording layer on which voltage is applied through the information recording electrode.

EXAMPLE 2

Polyvinyl carbazole and 2,4,7-trinitrofluorenone (TNF) were dissolved at a 1:1 molar ratio in tetrahydrofuran to prepare an 8% solution, which was then coated by blade coating (at a gap thickness of 4 mils) on an indium tin oxide film (with a thickness of 1,000 Å and a resistance value of 100 Ω/□) formed on a glass substrate by evaporation, followed by drying at 60° C. for 2 hours. Then, a photoconductive layer of 10 μm in thickness was stacked or otherwise formed on the product to prepare a photosensitive material.

Using a polyethylene terephthalate film of 12 μm in thickness as a spacer, the information recording layer of the electrostatic information recording medium obtained in Example 1 was opposed to the photoconductive layer of the photosensitive material mentioned just above with an air gap. Some region of the photosensitive material was exposed to light, and the other not. With the electrode of the photosensitive material kept negative, a voltage of −800 V was then applied between both the electrodes for 10 seconds.

After the application of the voltage, the electrostatic information recording medium was separated from the photosensitive material to measure the surface potential of the information recording layer. Consequently, the exposed region was found to have a surface potential of −170 V.

Then, the electrostatic information recording medium was placed on a hot plate for a 30-second heating at 25° C., whereby the surface potential of the exposed region of the information recording layer was increased to 0 V.

The exposed and unexposed regions of the information recording layer were uniformly charged by use of a Scorotron charger having a grid electrode at a corona voltage of −7 Kv, a grid voltage of −800 V, a distance of 3 cm between the information recording layer and the corona wire and a distance of 1.3 cm between the grid and the corona wire for 30 second.

After charging, the surface potential of the information recording layer was measured. As a results, the unexposed and exposed regions were found to have surface potentials of −40 V and −100 V, respectively. This indicates that the exposed region of the information recording layer on which the voltage is applied while the photosensitive material is exposed to light is improved in terms of the ability to be charged. Shown in FIG. 1 is the relation between the corona charging time (seconds) and the potential-after-charging (V) of the exposed and unexposed regions. In FIG. 1, white and black dots refer to the surface potentials of the unexposed and exposed regions, respectively.

EXAMPLE 3

Using an EB irradiator (Curetron EBC-200-AA2 made by Nisshin High Voltage Co., Ltd.), the information recording layer of the electrostatic information recording medium prepared in Example 1 was irradiated on the surface with electron beams at an acceleration voltage of 110 KV, an electron flow of 12 mA and a carrying velocity of 15 m/min., and at an exposure of 10 Mrad.

After the irradiation with electron beams, the surface of the information recording layer had a potential of 0 V. Under the same corona charging conditions as in Example 1, the surface regions of the information recording layer, which were irradiated with electron beams and not, were uniformly charged, and then measured in terms of potential.

Figure 2:
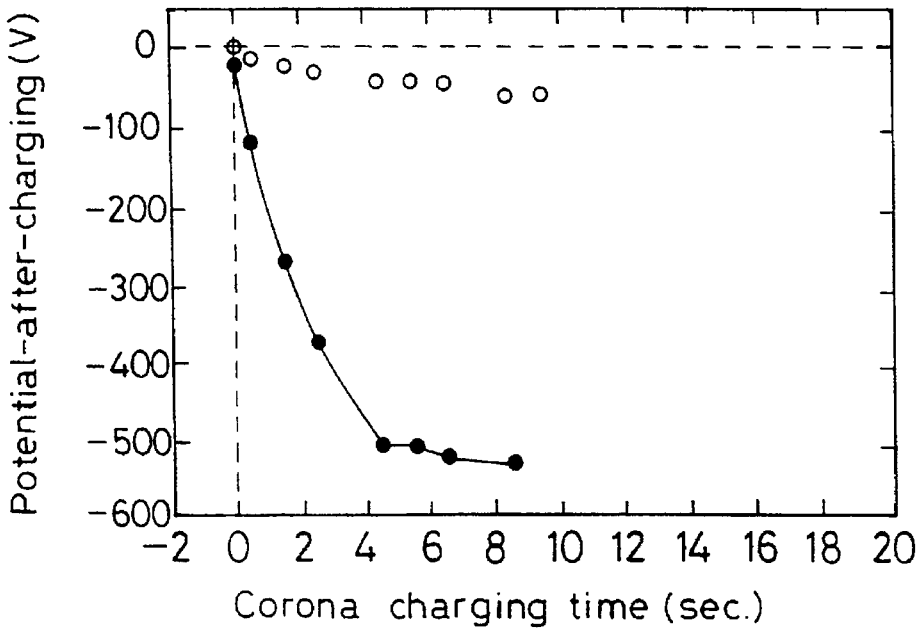
FIG. 2 is a graphical view showing the relation between the corona charging time (sec.) and the potential-after-charging (V) when the electrostatic information recording medium of the invention was irradiated with electron beams and then charged by means of a corona wire.

Shown in FIG. 2 is the relation between the corona charging time and the potential-after-charging. The region not irradiated with electron beams (shown by white dots) had a surface potential of −42 V, whereas the region irradiated with electron beams (shown by black dots) had a surface potential of −505 V. These results show that the ability to be charged is improved by exposure to electron beams.

EXAMPLE 4

Using ROM ERASER (RE-908 made by Sanhayato Co., Ltd.), the information recording layer of the electrostatic information recording medium prepared in Example 1 was irradiated on the surface with ultraviolet rays from a mercury lamp (253 nm) as an ultraviolet light source at a distance of 1 cm between the sample and the light source for 40 minutes.

After exposure to ultraviolet rays, the surface potential of the information recording layer was 0 V. Under the same corona charging conditions as in Example 1, the surface regions of the information recording layer, which were, and were not, irradiated with ultraviolet rays were uniformly charged, and then measured in terms of potential.

Figure 3:
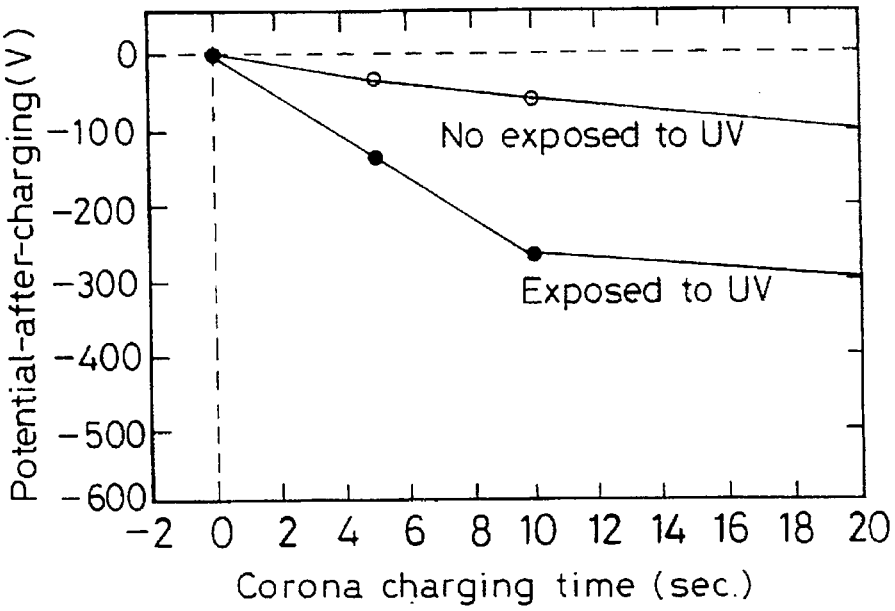
FIG. 3 is a graphical view showing the relation between the corona charging time (sec.) and the potential-after-charging (V) when the electrostatic information recording medium of the invention was irradiated with ultraviolet rays and then charged by means of a corona wire.

Shown in FIG. 3 is the relation between the corona charging time and the potential-after-charging. The region not irradiated with ultraviolet rays (shown by white dots) had a surface potential of −35 V, whereas the region irradiated with ultraviolet rays (shown by black dots) had a surface potential of −140 V. These results show that the ability to be charged is improved by exposure to ultraviolet rays.

EXAMPLE 5

The information recording layer of the electrostatic information recording medium prepared in Example 1 was charged on the surface at a corona voltage of −10 KV and a distance of 1.3 cm between the sample and the corona wire for 1 second.

After corona charging, the information recording layer had a surface potential of −143 V. Then, the electrostatic information recording medium was placed on a hot plate for a 10-second heating at 200° C., whereby the surface potential of the information recording layer was increased to 0 V. Following the erasure of the surface potential, the charged and uncharged regions of the surface of the information recording layer were uniformly charged under the same corona charging conditions as in Example 1, and then measured in terms of the potential-after-charging.

Figure 4:
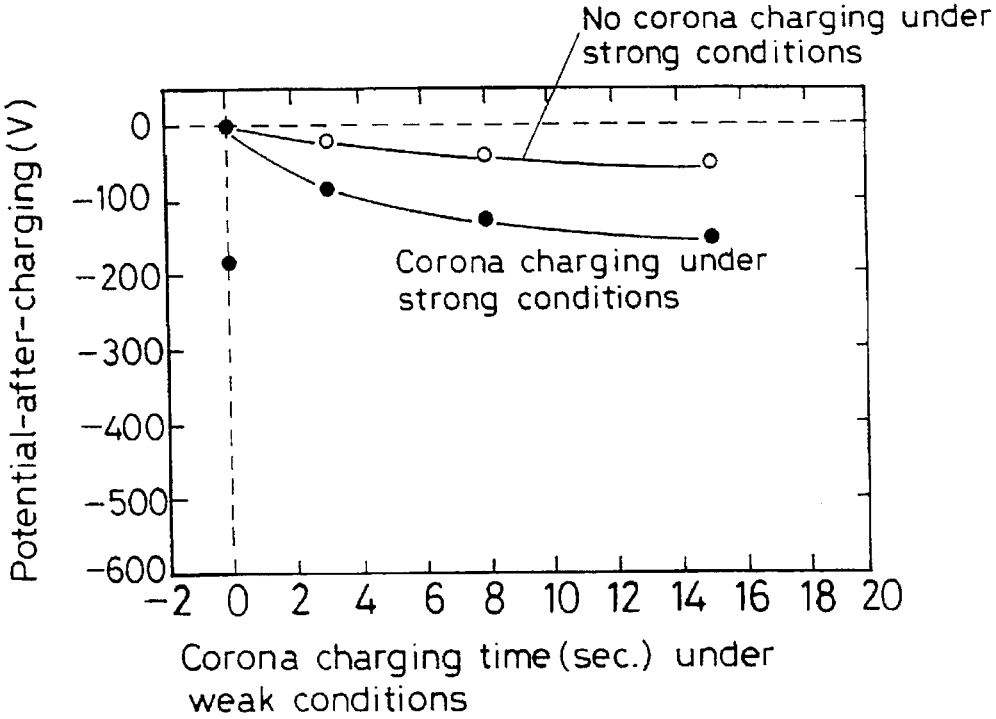
FIG. 4 is a graphical view showing the relation between the corona charging time (sec.) and the potential-after-charging (V) when the electrostatic information recording medium of the invention charged under strong conditions were re-charged under weak conditions.

Shown in FIG. 4 is the relation between the corona charging time and the potential-after-charging. Under strong conditions, the uncharged region had a surface potential of −35 V, whereas the charged region had a surface potential of −90 V. These results indicate that the ability of the information recording layer to be charged is enhanced by corona charging under strong energy conditions.

For the purpose of comparison, the information recording layer of the electrostatic information recording medium prepared in Example 1 was corona-charged on the surface under weak conditions, i.e., at a corona voltage of −7 KV and a distance of 3 cm between the sample and the corona wire for 15 minutes.

After corona charging, the information recording layer had a surface potential of −200 V. Then, the electrostatic information recording layer was placed on a hot plate for a 10 second heating at 200° C., whereby the surface potential of the information recording layer was increased to 0 V. Following the erasure of the surface potential, the charged and uncharged regions of the surface of the information recording layer were uniformly charged under the same corona charging conditions as in Example 1, and then measured in terms of the potential-after-charging.

under such weak conditions, the uncharged region had a surface potential of −35 V, and the charged region had again a surface potential of −35 V. These results indicate that corona charging under such weak energy conditions has no influence on the ability of the information recording layer to be charged.

EXAMPLE 6

The surface of the information recording layer of the electrostatic information recording medium prepared in Example 1 were rubbed 20 times with a wiper made up of 100% cellulose. Rubbing gave −175 V to the surface of the information recording layer. Then, the electrostatic information recording medium was placed on a hot plate for a 10-second heating at 200° C., whereby the surface potential of the information recording layer was increased to 0 V.

After the erasure of the surface potential, the surface regions of the information recording layer which were, and not were, rubbed were uniformly charged under the same conditions as in Example 1, and then measured in terms of the potential-after-charging.

Figure 5:
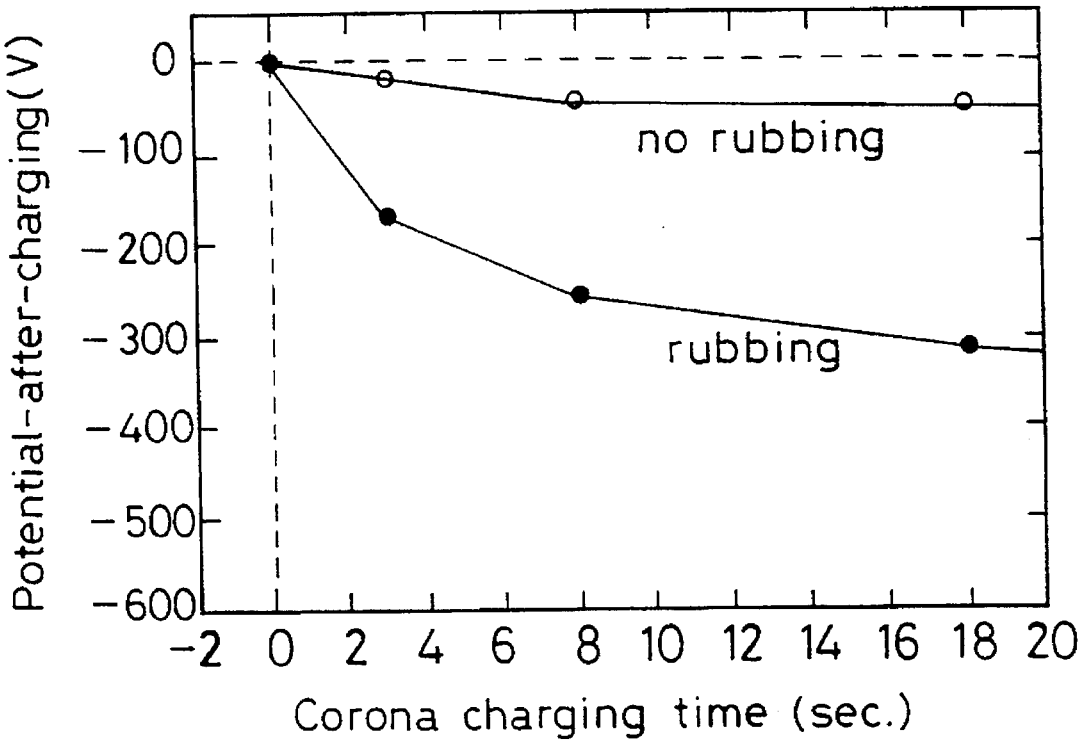
FIG. 5 is a graphical view showing the relation between the corona charging time (sec.) and the potential-after-charging (V) when the information recording layer of the electrostatic information recording medium of the invention was mechanically rubbed on the surface and then charged by means of a corona wire.

Shown in FIG. 5 is the relation between the corona charging time and the potential-after-charging. The region that was not rubbed had a surface potential of −30 V, whereas the rubbed region had a surface charge of −200 V. These results show that the ability of the information recording layer to be charged is enhanced by rubbing.

EXAMPLE 7

A part of the information recording layer of the electrostatic information recording medium prepared in Example 1 was deposited by sputtering with gold at a thickness of 1,000 Å, thereby forming a trap.

The parts of the information recording layer which were, and not were, deposited with gold were uniformly charged by use of a corona charger at a corona voltage of −7 Kv and a distance of 3 cm between the information recording layer and the corona wire for 10 seconds. After charging, the surface potential was measured. Consequently, the part not deposited with gold had a surface potential of −60 V, whereas the part deposited with gold had a surface potential of −600 V. These results teach that the ability of the information recording layer to be charged is enhanced by the deposition of gold.

What is claimed is:

1. An electrostatic information recording medium, comprising at least one electrode having thereon an information recording layer, wherein said information recording layer comprises a product obtained by contact of a polymer having a fluorine-containing aliphatic ring structure with fluorine gas, wherein a latent image charge trap is held on said information recording layer.

2. A method of forming a latent image charge trap, comprising irradiating an electrostatic information recording medium having on at least one electrode an information recording layer comprising a product obtained by contact of a polymer having a fluorine-containing aliphatic ring structure with fluorine gas with at least one member selected from the group consisting of electrons, atoms, molecules and ions to form a latent image charge trap on the information recording layer.

3. A method of forming a latent image charge trap, comprising irradiating an electrostatic information recording medium having on at least one electrode an information recording layer comprising a product obtained by contact of a polymer having a fluorine-containing aliphatic ring structure with fluorine gas with light to form a latent image charge trap on the information recording layer.

4. A method of forming a latent image charge trap, comprising providing an electrostatic information recording medium having on at least one electrode an information recording layer comprising a product obtained by contact of a polymer having a fluorine-containing aliphatic ring structure with fluorine gas, and mechanically treating the surface of the information recording layer to form a latent image charge trap on the information recording layer.

5. A method of forming a latent image charge trap, comprising forming on at least one electrode an information recording layer comprising a product obtained by contact of a polymer having a fluorine-containing aliphatic ring structure with fluorine gas, and forming an electrically conductive or insulating substance on said information recording layer in an imagewise configuration, thereby forming a latent image charge trap on the information recording layer.

6. A method of recording and reproducing electrostatic information, comprising providing an electrostatic information recording medium having on at least one electrode an information recording layer comprising a product obtained by contact of a polymer having a fluorine-containing aliphatic ring structure with fluorine gas, uniformly charging the surface of the information recording layer of the electrostatic information recording medium on which layer a latent image charge trap is retained, catching electrostatic charges in said trap, and reading said electrostatic charges to reproduce an image recorded in the information recording layer.

7. A method of recording and reproducing electrostatic information, comprising providing an electrostatic information recording medium having on at least one electrode an information recording layer comprising a product obtained by contact of a polymer having a fluorine-containing aliphatic ring structure with fluorine gas, uniformly charging the surface of the information recording layer of the electrostatic information recording medium on which layer a latent image charge trap is retained, catching electrostatic charges in said trap, and developing said electrostatic charges with a toner to reproduce an image recorded in the information recording layer.

* * * * *